US005435138A

United States Patent [19]

Silvestri, Jr.

[11] Patent Number: 5,435,138

[45] Date of Patent: Jul. 25, 1995

[54] REDUCTION IN TURBINE/BOILER THERMAL STRESS DURING BYPASS OPERATION

[75] Inventor: George J. Silvestri, Jr., Winter Park, Fla.

[73] Assignee: Westinghouse Electric Corp., Pittsburgh, Pa.

[21] Appl. No.: 195,497

[22] Filed: Feb. 14, 1994

[51] Int. Cl.[6] ..... F01K 13/02; F01D 17/04

[52] U.S. Cl. ..... 60/652; 60/667

[58] Field of Search ..... 60/646, 667, 652, 679

[56] References Cited

U.S. PATENT DOCUMENTS

| | | | |
|---|---|---|---|
| 3,630,839 | 12/1971 | Podolsky | 60/652 |
| 4,297,848 | 11/1981 | Silvestri, Jr. | 60/660 |
| 4,408,458 | 10/1983 | Torii | 60/660 |
| 4,576,008 | 3/1986 | Silvestri, Jr. | 60/662 |
| 4,728,254 | 3/1988 | Schmitz-Josten et al. | 60/652 |
| 4,862,692 | 9/1989 | Fukuda et al. | 60/667 |
| 4,870,823 | 10/1989 | Silvestri, Jr. | 60/667 |

OTHER PUBLICATIONS

Technical Paper "Ten years experience with large pulverized coal-fired boilers for utility service" BR-1218 Babcock & Wilcox Presented to American Power Conference Chicago, Ill., Apr. 26-28, 1982.

*Primary Examiner*—Ira S. Lazarus
*Assistant Examiner*—L. Heyman
*Attorney, Agent, or Firm*—M. G. Panian

[57] ABSTRACT

A method of reducing turbine inlet temperature excursions during sudden load demand reductions on a steam turbine, the turbine being coupled to a controllable source of high pressure, high temperature steam, incorporates throttling of steam within the steam source in conjunction with steam throttling at the turbine so as to apportion temperature drops between the source and turbine. In one form, the method includes the steps of sensing a sudden drop in load demand on the steam turbine, operating the steam source to reduce exit pressure of the steam at the steam source and bypassing sufficient steam around the steam turbine to reduce steam flow through the turbine by an amount commensurate with the drop in load demand. The steam source may be controlled by adjusting division valves between primary and secondary superheaters in the steam source to throttle steam pressure at the secondary superheater and then heating the steam in the secondary superheater to a temperature which compensates for the temperature drop across the division valves caused by throttling.

2 Claims, 3 Drawing Sheets

REDUCTION IN TURBINE/BOILER THERMAL STRESS DURING BYPASS OPERATION

BACKGROUND OF THE INVENTION

The present invention relates to steam turbines and, more particularly, to a method of controlling operation of a steam turbine bypass system in conjunction with steam boiler control to prevent rapid temperature excursions in response to sudden drops in load demand.

In a typical steam turbine power plant, a steam generator such as a boiler produces steam which is provided to a high pressure (HP) turbine through a plurality of steam admission valves. Steam exiting the high pressure turbine is reheated in a conventional reheater prior to being supplied to a lower pressure turbine, the exhaust from which is conducted into a condenser where the exhaust steam is converted to water and supplied to the boiler to complete the cycle. A typical power utility system will employ one or more HP turbines, an intermediate pressure (IP) turbine and a low pressure (LP) turbine. The turbines are generally coupled to drive a synchronous electric power generator at constant speed for producing electric utility power which is transmitted over a transmission link to various users.

With steam turbines equipped with a steam bypass system, the steam admission valves to the turbine may be closed, or partially closed, while still allowing steam to be produced by the boiler at a load level independent of steam turbine load by directing the excess steam through the bypass system to the condenser. The bypass system is advantageously used for hot restarts or to keep the boiler on-line during plant or system transients that would normally require a trip (shutdown),i.e., a sudden loss of load demand such as might be caused by a loss or interruption on the power transmission link. Accordingly, bypass systems are provided in order to enhance on-line availability, obtain quick restarts, and minimize turbine thermal cycle expenditures.

In the event of a sudden drop in load demand, it is still desirable to operate the steam turbine system at a house load level so as to supply the electrical needs of auxiliary equipment such as pumps, pulverizers, fans, etc. Under such conditions, the turbine will continue running at synchronous speed although with a greatly reduced steam flow and with the remainder of the boiler-produced steam being provided to the bypass system.

Ordinarily, sufficient steam flow must be passed through the turbine in order to keep the turbine elements cool. With the reduced flow rate conditions, however, a windage effect takes place whereby instead of extracting work from the steam, the turbine blades are actually doing work on the steam which is being churned up, resulting in a temperature increase which in turn causes the turbine parts to heat up. A danger therefore exists under such conditions, of turbine overheating past its design rating, thereby resulting in reduced life and possible premature failure. U.S. Pat. No. 4,576,008 describes an improved bypass system which provides a sufficiently low pressure at the HP turbine exhaust so as to maintain the temperature of the turbine components within design limits.

For a typical reheat turbine bypass system, all but a small fraction of the main steam flow is diverted around the HP element and is directed to a pressure reducing and desuperheating station. The pressure is reduced to a level that corresponds to the HP exhaust (cold reheat) pressure that existed prior to the load interruption. The HP exhaust pressure level is maintained by the combined action of additional bypass valves at the reheater outlet and modulating interceptor valves at the IP section inlet. The major portion of the steam flow is directed to the condenser by the bypass valves at the hot reheat outlet. Sufficient flow is passed through the HP, IP and LP sections to meet the auxiliary load of the plant.

When the electrical connection with the load center is restored, the flow through the bypass system is reduced and the turbine section flows are correspondingly increased to increase the generator output. There is no time lag introduced by the boiler as its steaming capability has been maintained at the level prior to the load center loss. When the duration of the load loss is longer than some predetermined interval, the boiler heat input is reduced with a concurrent reduction in the bypass flow and the auxiliary power requirements. During the change to a lower level of boiler input energy, the HP exhaust pressure and consequently the cold and hot reheat pressures are reduced to a level consistent with the lower main steam flow. The main steam flow (and consequently the boiler heat input) are reduced to a level consistent with extended low load operation and this also reduces the energy consumption of the plant.

When the bypass system is initially activated with a conventional bypass system in which boiler steaming capacity is maintained, there is a rapid increase in HP section exhaust temperature and a rapid decrease in HP section inlet blading temperature. If the HP section has a partial-arc admission first stage, the first stage exit temperature decreases even more than the first stage inlet temperature, possibly by more than 200° F. depending upon the active arc of admission.

Because of the large decrease in HP turbine blading inlet flow, the control valves must throttle. Steam, not being a perfect gas, decreases in temperature when it is throttled. For example, in going from full load to house load, the steam flow is reduced by a factor of about 12, which means that the control valve discharge pressure is about 8% of the full load pressure. In the case of 2400 psia, 1000° F. steam, its temperature decreases by about 120° F. For 3500 psia, 1000° F. steam, the temperature change is about 180° F. So the HP first stage inlet temperature would be 120° F. to 180° F. lower than the full load temperature immediately after the bypass system is activated. As a result, there is a large thermal transient imposed upon the control valve body, inlet piping, HP inner shell inlet (nozzle chambers if they are present), and HP rotor.

If the first stage is a full-arc or fixed-arc admission stage, its exit temperature would decrease by about the same amount as its inlet temperature. In the case of a typical Rateau type fixed-arc admission stage, the difference between the stage inlet and outlet temperatures would be about 65° F. If the first stage were a partial-arc admission Rateau stage with 50% minimum admission, the first stage exit temperature would decrease by an additional 105° F. So the total change in the first stage exit temperature is the temperature change resulting from the throttling and the 105° F. blading induced change. Consequently, for a 2400 psia turbine, the total decrease in first stage exit temperature is 225° F. (120° F. plus 105° F.) and is 285° F. (180° F. plus 105°) for 3500 psia steam.

The majority of the downstream stages in the HP section do work on the steam because of windage heating (low flow and elevated HP exhaust pressure). As a result, the steam temperature will increase from stage to stage to a level where it may not be tolerable. The increase in HP exhaust temperature also causes thermal stress at the exhaust. The above mentioned U.S. Pat. No. 4,576,008 "Turbine Protection System for Bypass Operation" presents a solution to the HP exhaust temperature change.

SUMMARY OF THE INVENTION

Among the several objects of the present invention may be noted the provision of a method of mitigating blading inlet temperature excursions and the provision of a method for mitigating first stage exit temperature excursions while maintaining a relatively short-term recovery cycle for a steam turbine and boiler system.

The method of the present invention implements a rapid reduction in steam flow and turbine throttle valve inlet pressure in such a manner that both the steam source (boiler) and the HP turbine do not experience excessive steam temperature changes. The method apportions the total change in steam temperature so both boiler and turbine operate in a more benign environment. In an exemplary form, sensors respond to a sudden drop in load demand producing signals to an integrated control system (ICS) coupled in operative arrangement to both the steam source and the steam turbines. The ICS responds by immediately initiating a steam flow reduction to the turbines by opening a bypass valve to shunt steam around the turbines and directly to a condenser. Concurrently with opening the bypass valve, steam flow to the turbine is throttled. Throttling results in a steam temperature drop in which the magnitude of the drop is related to the initial valve pressure and to the pressure drop across the valve. In order to reduce this temperature excursion, the ICS also throttles steam flow within the steam source. In particular, the ICS actuates division valves between superheaters in the steam source to reduce steam pressure. Although actuation of the division valves also reduces steam temperature, this temperature loss is made up by a secondary superheater downstream of the division valves. Accordingly, the steam supplied to the turbine throttle valves is at a lower pressure but about the same temperature as was received prior to steam flow reduction. The temperature drop across the turbine throttle valves is therefore reduced allowing hotter steam to be supplied to the turbine.

In a preferred method, the division valves are so controlled that the boiler shares the total overall temperature drop with the turbine.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 1:
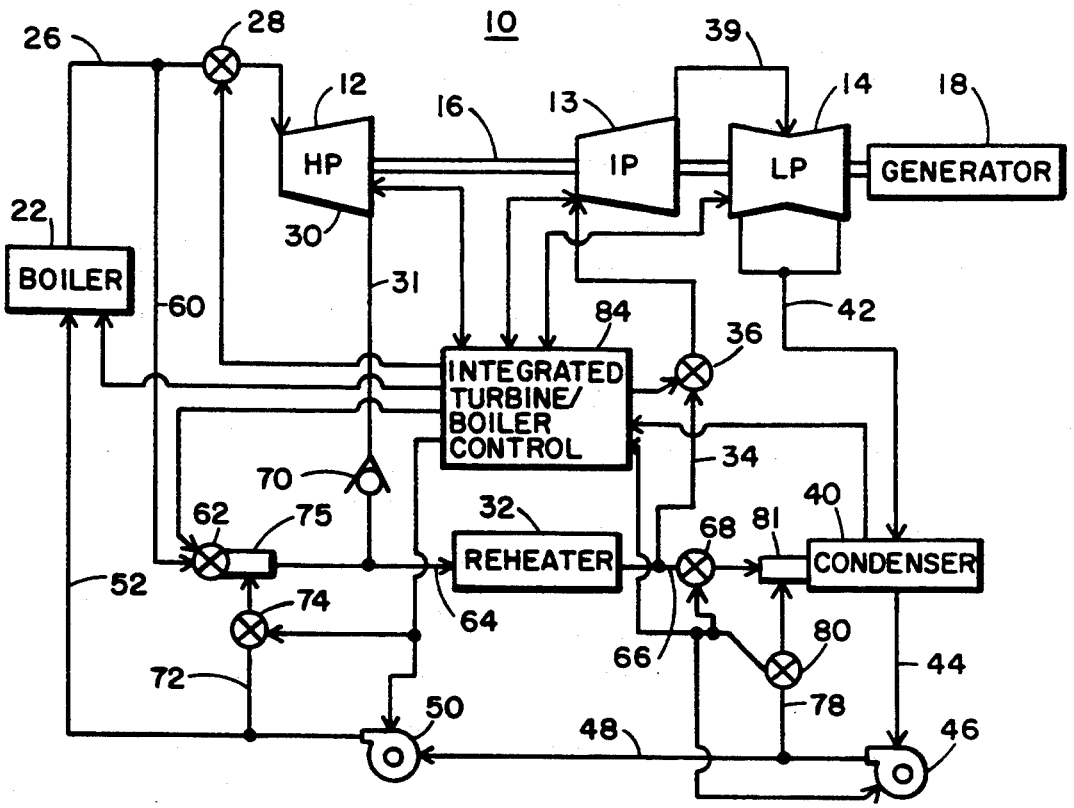
FIG. 1 (PRIOR ART)
FIG. 1 is a simplified illustration of a steam turbine generator system with which the present invention may be used.

FIG. 1 illustrates a simplified block diagram of a conventional fossil-fired single reheat steam turbine generator unit, by way of example. The turbine system 10 includes a plurality of turbines in the form of high pressure (HP) turbine 12, and at least one or more lower pressure turbines which, in the case of FIG. 1, include intermediate pressure (IP) turbine 13 and low pressure (LP) turbine 14. The turbines are connected to a common shaft 16 to drive an electrical generator 18 which supplies power to a load such as an electrical grid network (not illustrated).

A steam generating system, such as a conventional boiler 22 operated by fossil fuel, generates steam which is heated to proper operating temperatures and conducted through a throttle header 26 to the high pressure turbine 12, the flow of steam being governed by a set of steam admission valves 28. The boiler 12 may be a once-through type or a drum type. A detailed description of several types of boilers is given in the text book "Steam" published by the Babcock & Wilcox Company.

Steam exiting the high pressure turbine 12 via the high pressure turbine exhaust outlet 30 and steam line 31 is conducted to a reheater 32 (which generally is in heat transfer relationship with boiler 22) and thereafter provided via steam line 34 to the intermediate pressure turbine 13 under control of valving arrangement 36. Thereafter, steam is conducted via steam line 39, to the low pressure turbine 14, the exhaust from which is provided to condenser 40 via steam line 42 and converted to water. The water is provided back to the boiler 22 via the path including water line 44, pump 46, water line 48, pump 50, and water line 52. Although not illustrated, water treatment equipment is generally provided in the return line so as to maintain a precise chemical balance and a high degree of purity of the water.

In order to enhance on-line availability, optimize hot restart, and prolong the life of the boiler, condenser, and turbine system, there is provided a turbine bypass arrangement whereby steam from boiler 22 may continually be produced as though it were being used by the turbines, but in actuality bypassing them. The bypass path includes steam line 60, with initiation of high pressure bypass operation being effected by actuation of high pressure bypass valve 62. Steam passed by this valve is conducted via steam line 64 to the input of reheater 32 and flow of the reheated steam in steam line 66 is governed by a low pressure bypass valve 68 which passes the steam to the condenser 40. In order to prevent the bypassed steam from entering the high pressure turbine in the reverse direction, that is through outlet 30 via steam line 31, there is provided a non-return or check valve 70 located in that steam line.

In order to compensate for the loss of heat extraction normally provided by the high pressure turbine 12 and to prevent overheating of the reheater 32, relatively cool water in water line 72 provided by pump 50 is provided to the bypass steam under control of spray valve 74 and desuperheating assembly 75. In a similar fashion, relatively cool water in water line 78, provided by pump 46, is controlled by valve 80 and provided to desuperheater assembly 81 in order to cool the steam in the low pressure bypass path to compensate for the loss of heat extraction normally provided by the intermediate and low pressure turbines 13 and 14 and to prevent overheating of condenser 40.

An integrated control system represented by ICS 84 is coupled to the turbines 12,13 and 14 wherein sensors provide data representative of turbine operation, including shaft speed and steam temperature and pressure at various points in each turbine. The ICS is also coupled to boiler 22 for both control and for sensing operation conditions. Each of the steam control valves described above is controlled by the ICS 84. A more detailed description of such a control system is shown in U.S. Pat. No. 4,297,848 assigned to the assignee of the present invention.

The windage heating which can cause extensive damage to the high pressure turbine 12 is a function of turbine rotor speed as well as the density of the steam being passed through the high pressure turbine. When operating under house load conditions with a low steam flow, the turbine is maintained at its design synchronous speed. The density of the steam therefore is a variable which affects the windage heating and the density increases with increased pressure at outlet 30. The problem is particularly serious in a power plant having a 100 percent bypass system.

Valve 62 in the bypass path throttles some of the boiler output pressure down to a certain value for presentation to the input of reheater 32. This pressure is known as the cold reheat pressure. Accordingly, if the exhaust pressure at outlet 30 is higher or equivalent to the cold reheat pressure, then a flow of steam could be maintained from the turbine to the reheater. This elevated pressure however would result in windage heating which is totally unacceptable for the turbine design. The pressure at outlet 30 must be kept relatively low so as to maintain the operating temperature within design limits, however, each low pressure is not compatible with the pressure conditions at the input of reheater 32 and therefore cannot be directly connected thereto. U.S. Pat. No. 4,576,008, assigned to the assignee of the present invention, discloses a method and apparatus for resolving this problem of windage heating at low pressures.

Figure 2:
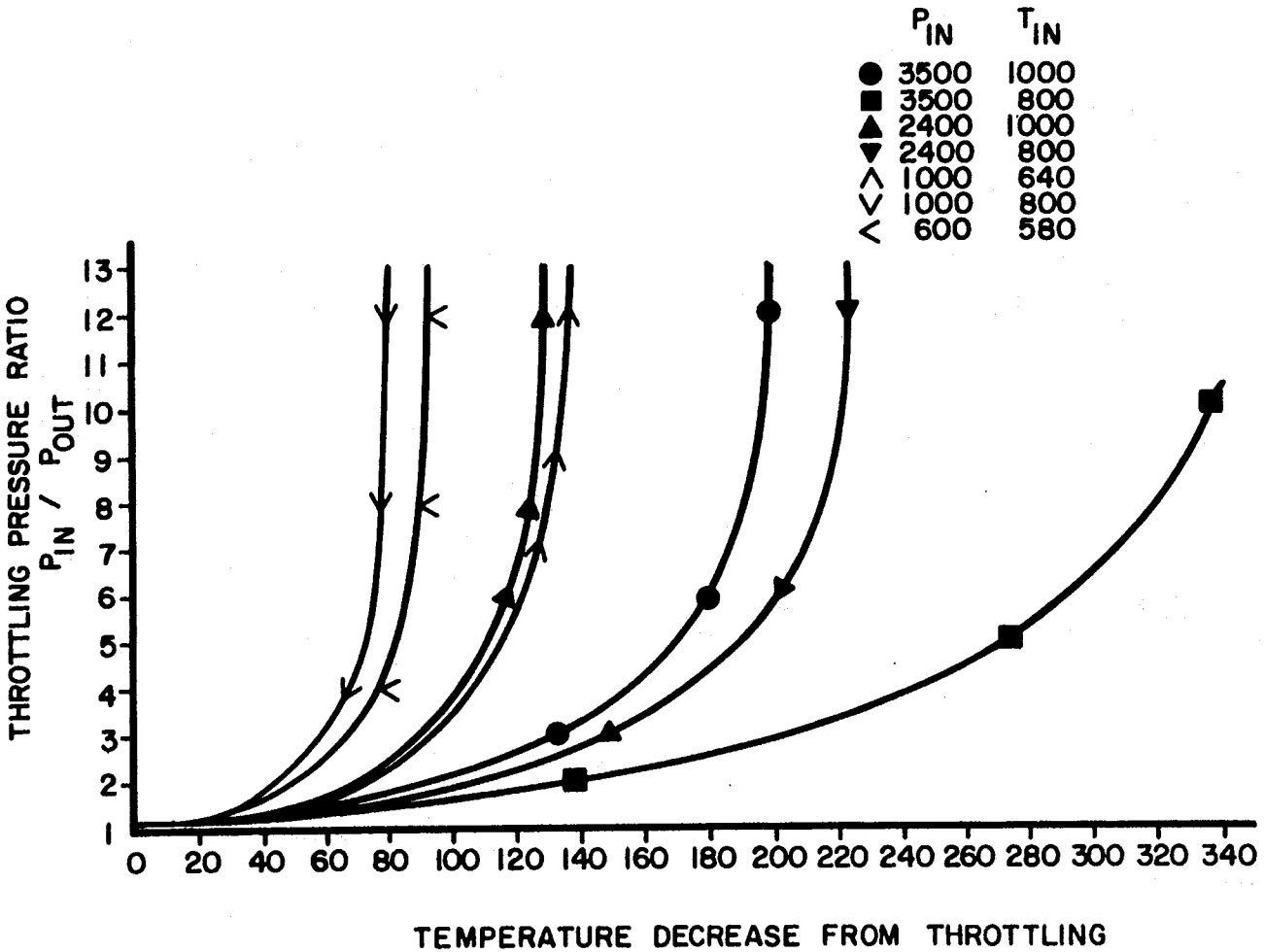
FIG. 2 is a graph of steam temperature variation as a result of steam throttling.

When steam to turbine 12 is throttled, not only is the pressure reduced, but the temperature of the steam is also reduced. Referring to FIG. 2, there is illustrated a graph of steam temperature variation as a function of steam pressure variation by throttling. If the initial pressure is 2400 psia at a temperature of 800° F., throttling to 800 psia (PIN/POUT=3) will result in an immediate 150° F. drop in temperature. As discussed above, this temperature excursion results in a significant thermal stress being placed on the turbine components, including the blades and shaft. Applicant has discovered that at least some of this temperature excursion can be eliminated by throttling at the boiler 22 to reduce pressure at the turbine throttle valve header 26.

Figure 3:
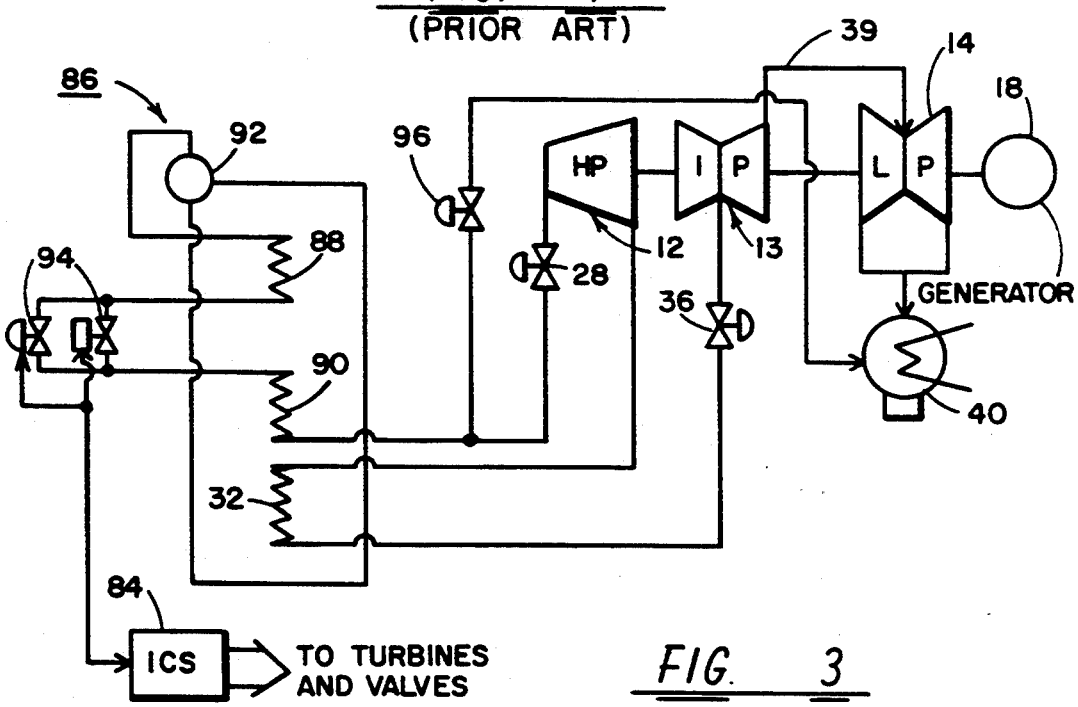
FIG. 3 is a simplified illustration of a steam turbine system of the type shown in FIG. 1 and incorporating the present invention.

Turning now to FIG. 3, there is shown a simplified illustration of a turbine-generator system including a boiler 86 having a primary superheater 88 and a secondary superheater 90. Reheater 32 is shown as part of the boiler 86. Steam produced in the main boiler section 92 passes sequentially through the primary superheater 88 and secondary superheater 90. A plurality of division valves 94 are coupled in the steam flow path between the primary and secondary superheaters. In a once-through type boiler, the valves 94 are used at start-up. In a drum-type boiler, the valves 94 are sometimes used to maintain drum pressure during sliding or variable pressure operation of a turbine. The ICS 84 is coupled to control the valves 94 using conventional control systems.

Upon sensing a sudden drop in load demand, ICS 84 operates valve 96 to bypass some steam directly from boiler 86 to condenser 40, concurrently throttling valve 28 to reduce steam pressure at turbine 12. In the present invention, ICS 84 also adjusts valves 94 to begin throttling steam from primary superheater 88 to secondary superheater 90. Assuming the steam temperature leaving the primary superheater 88 is 800° F. at a pressure of 2500 psia, the drop in temperature resulting from division valve throttling is about 110° F. if the pressure is reduced to about 1200 psia and about 180° F. if the pressure is reduced to 600 psia. If the throttled steam is then heated in the secondary superheater to about 1000° F. (normal exit temperature), the temperature drop caused by throttling of valve 28 is significantly reduced. For example, throttling of 1200 psia, 1000° F. steam to 120 psia results in only a 62° F. change in temperature while throttling of 600 psia, 1000° F. steam to 120 psia only results in a 27° F. temperature drop.

Use of the division valves 94 to adjust boiler output avoids a temperature change in the boiler drum (main boiler section 92), which is important since boiler drum manufacturers limit drum temperature changes from about 85° F. to 150° F. in 15 minutes. Since the drum is the limiting factor on temperature change, reverting to modified sliding pressure with bypass operation and quickly reducing main steam flow (and therefore reheater and condenser flow) will minimize temperature changes at both the HP turbine first stage inlet and exit and at the HP turbine last stage exit. This latter effect is achieved by adopting the teachings of Pat. No. 4,576,008. Because of the reduced temperature changes, the turbines can be loaded at the maximum allowable rate of the boiler with much lower thermal stress. Because of the thin walls of the boiler tubing, which receive steam from the division valves, they can withstand larger temperature changes than a thick wall drum or a turbine shell. Since the temperature drop in the division valve 94 is distributed over many individual throttlings (because the division valves 94 are typically stacked disc configurations creating multiple stages), the probability of excessive thermal stress in this valve is low.

If the division valve discharge pressure is 1200 psia, the boiler will be operating at about 50% flow which would correspond to about 60% load at 1200 psia if bypass operation is terminated. If the boiler load increase is limited to 5% per minute, full load could be achieved in 8 minutes. If the load increase is 10% per minute at 60% load, full-load would be achieved in 4 minutes.

If the boiler 86 is of a type which does not include division valves 94 but instead operates with sliding pressure at reduced load, the system controller, ICS 84, will ramp boiler exit pressure down to about 1200 psia resulting in about a 100° F. change in drum steam temperature. Steam flow would be reduced to about one-half of normal. The bypass system, i.e., valve 68, would be opened at the start of load demand interruption. When 1200 psia is reached, the turbine control valves 28 are throttled to a desired value, e.g., about 120 psia to maintain house loads, at the same admission arc as prior to the load loss, resulting in about a 60° F. temperature change in steam at the turbine first stage inlet. Consequently, the thermal stress on the turbine is limited.

Figure 4:
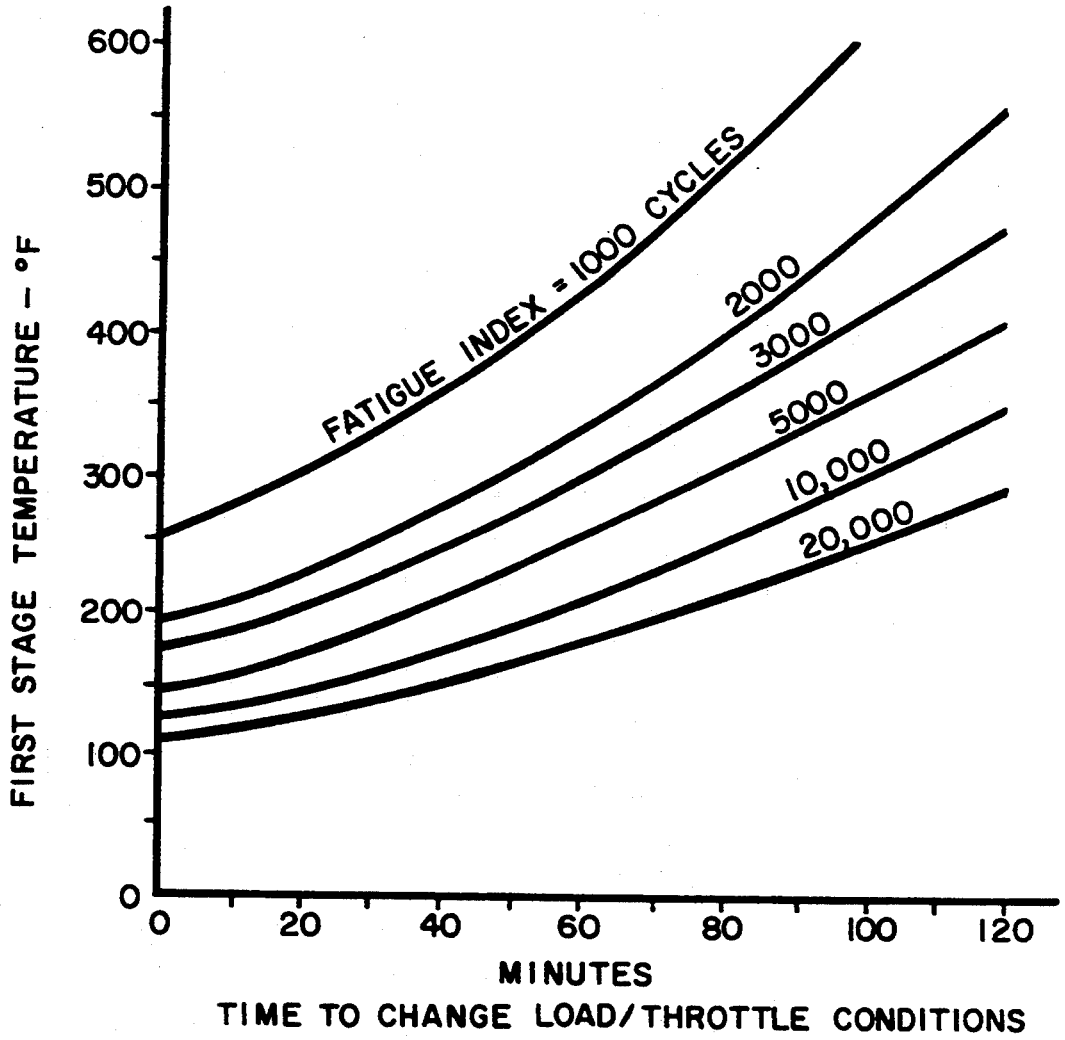
FIG. 4 is a graph of steam turbine fatigue index as a function of steam turbine first stage temperature variation and time.

The significance of applicant's invention in improving turbine life can be better appreciated by reference to FIG. 4 which plots a fatigue index as a function of first stage exit temperature change and time over which the change occurs. For sudden drops in load demand, if throttling is immediately applied reseulting in a first stage temperature excursion of about 200° F., the fatigue index forecasts a life of less than 2000 cycles for the turbine. If the temperature excursion can be reduced to about 100° F., the turbine life is expected to exceed 20,000 cycles. Accordingly, sharing the total temperature drop between the boiler and turbine so that the turbine temperature excursions are limited results in a significant improvement in turbine life.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A method of reducing turbine inlet temperature excursions during sudden load demand reductions on a steam turbine, the turbine being coupled to a controllable source of high pressure, high temperature steam, the method including the steps of:

sensing a sudden drop in load demand on the steam turbine;

operating the steam source to reduce exit pressure of the steam at the same source while maintaining substantially constant steam temperature from the steam source;

bypassing sufficient steam around the steam turbine to reduce steam flow through the turbine by an amount commensurate with the drop in load demand; and adjusting the reduction of steam pressure to a value such that any variation in steam temperature at the steam source is substantially equal to any steam temperature variation at the steam turbine during the step of bypassing.

2. A method of reducing turbine inlet temperature excursions during sudden load demand reductions on a steam turbine, the turbine being coupled to receive steam from a boiler having a primary and a secondary superheater and at least one division valve coupled in a steam flow path between the primary and the secondary superheaters, the method including the steps of:

sensing a sudden drop in load demand on the steam turbine;

adjusting the division valve to throttle steam pressure at the secondary superheater;

heating the steam in the secondary superheater to a temperature which compensates for a temperature drop across the division valve caused by throttling;

bypassing sufficient steam around the steam turbine to reduce steam flow through the turbine by an amount commensurate with the drop in load demand;

throttling steam pressure at the turbine by an amount sufficient to limit flow to the turbine to the load demand; and adjusting the throttling of the division valve and the throttling at the turbine to generally equally divide the required throttling between the two throttling locations.

* * * * *